US006290347B1

(12) United States Patent
Stolk et al.

(10) Patent No.: US 6,290,347 B1
(45) Date of Patent: Sep. 18, 2001

(54) INK JET ARRAY

(75) Inventors: Hendrik Jan Stolk, Bergen; Peter Joseph Hollands, Baarlo, both of (NL)

(73) Assignee: Oce-Technologies B.V., Ma Venlo (NL)

( * ) Notice: Subject to any disclaimer, the term of this patent is extended or adjusted under 35 U.S.C. 154(b) by 0 days.

(21) Appl. No.: 09/482,879

(22) Filed: Jan. 14, 2000

(30) Foreign Application Priority Data

Jan. 25, 1999 (NL) ..... 1011128

(51) Int. Cl.[7] ..... B41J 2/175
(52) U.S. Cl. ..... 347/86
(58) Field of Search ..... 347/84, 85, 86, 347/87, 70, 71, 72, 93

(56) References Cited

U.S. PATENT DOCUMENTS 4,364,067 12/1982 Koto et al. ..... 347/70
5,604,522 * 2/1997 Miura et al. ..... 347/70

FOREIGN PATENT DOCUMENTS

A1-2340855 2/1975 (DE) .
A2-0721839 7/1996 (EP) .
A1-0854038 7/1998 (EP) .

OTHER PUBLICATIONS

English language abstract of Japanese reference 55/067476, K. Hiromichi, "Ink Jet Head", May 21, 1980.

* cited by examiner

*Primary Examiner*—N. Le
*Assistant Examiner*—Michael Nghiem
(74) *Attorney, Agent, or Firm*—Birch, Stewart, Kolasch & Birch, LLP

(57) ABSTRACT

A device for delivering ink to a sheet of paper or the like, which includes a body member containing side surface portions which extend into a head surface portion, the head surface portion being inclined at an angle relative to the side surface portions and the body member between the end surface portion and the side surface portions being formed with a curved transition zone, the body member containing an ink inlet for letting in ink originating from an ink reservoir, ink delivery nozzles disposed at the head surface portion and ink passages in the form of ducts extending between the inlet and the ink delivery nozzles along one or more of the side surface portions of the body member, a first ink-tight layer which covers the ducts, the ducts terminating in ends at the ink delivery nozzles, and a second ink-tight layer which covers the ends of the ink passages in which second ink-tight layer the ink delivery nozzles are formed, and ink propulsion device operatively connected with the ink-tight layer for selectively propelling ink through the ink passages to the ink delivery nozzles.

10 Claims, 1 Drawing Sheet

INK JET ARRAY

BACKGROUND OF THE INVENTION

The present invention relates to a device for delivering ink, more particularly to a print head for an ink jet printer, provided with a series of ink delivery nozzles which can be actuated selectively when printing a sheet of paper or the like. The present invention also relates to an ink jet printer provided with such a device.

One known device of this kind has a substantially triangular base plate, the apex of which is directed towards the sheet for printing, and the oblique sides of which are provided with a number of ink ducts covered by a foil and extending to near the bottom or head end of the base plate, where they extend in the form of ink tunnels through the base plate towards the head surface. There the nozzles of the ink tunnels are covered by a nozzle plate, possibly in the form of a foil, in which a hole is made for each ink passage. Piezo-electric elements are disposed at the location of the foil over the ducts on the oblique sides and can be actuated selectively in order to briefly press on the foil above a duct and thus create a pressure pulse in the ink there, so that a droplet is delivered from the associated nozzle.

U.S. Pat. No. 4,364,067 discloses a print head attachment having a substantially rectangular base plate, the top of which is provided with an ink inlet connected to an ink reservoir and terminating in an ink distribution chamber to which are connected a number of ducts formed in the two sides. These ducts converge with an arc in the plane of the associated side to a number of downwardly directed ink delivery nozzles provided in a nozzle plate disposed in the base plate head surface situated transversely of the sides. The ink delivery nozzles form a Y-shaped duct, the branches of which extend to ducts on the opposite sides of the base plate.

The ducts themselves are covered by a vibrating plate on which an electrode is mounted. Provided on the electrode, at the location of the pressure chambers, are piezo-electric elements, which are also provided with an electrode. Selective actuation of the piezo-electric elements causes the vibrating plate to be pressed in locally and the volume of the pressure chamber in the required duct is reduced so that a specific quantity of ink is propelled through said duct to the associated ink delivery nozzle.

A disadvantage of the known printer heads is that the ink-tight layers adjoin one another at an angle so that sealing may be locally inadequate.

SUMMARY OF THE INVENTION

From one aspect, the object of the present invention is to provide an improvement in this respect.

To this end, the present invention provides a device for delivering ink to a sheet of paper or the like, comprising a body with sides and a head end disposed at an angle to the sides and containing an inlet for the ink originating from a reservoir. A plurality of ink delivery nozzles are provided at the head end, and a plurality of ink passages extend between the inlet and the ink delivery nozzles and are located on that side of the body as the ink passages in the form of ducts where ink propulsion means, e.g. piezo-electric elements selectively operate. An ink-tight layer, such as a suitable foil, extends between the piezo-electric elements and the ducts, whereby the ends of the ink passages situated at the ink delivery nozzles are covered by an ink-tight layer in which the ink delivery nozzles are formed.

The body between the head end and the adjoining side in which the ink passages are provided is formed with a curved transition zone. The presence of the curved transition zone makes it possible to continue the ink-tight layer at the location of the head surface and/or at the location of the ducts in the side or sides, at least as far as providing a smooth connection between the ink-tight layer of respectively one side or head surface, without the layer having to extend over a gap such as a sharp angle, where the layer may be permanently deformed due to kinking and thus would not provide adequate sealing.

In the known print head attachments, separate covers are used at the location of the ducts at the piezo-electric elements and at the location of the delivery nozzles. The manufacture of the print head attachments thus requires a double operation which has to be carried out with great accuracy. From a further aspect, the object of the present invention is to provide improvement in this respect. To this end, according to the present invention, the ink-tight layer at the location of the ink propulsion means forms a unit with the ink-tight layer at the location of the ink delivery nozzles. Thus a single ink-tight layer is sufficient for the head surface and side. The manufacture of the print head attachment is thus greatly simplified and more easily controlled.

This advantage is enhanced if the body is provided with two opposite sides in which the ink passages are provided, a curved transition zone being provided at both sides, wherein the ink-tight layer extends as a unit over both sides and over the head end.

As a result of the curved shape of the transition zones it is also possible to continue the ducts in a simple manner as far as the ink delivery nozzles. Advantageously, the associated side and the adjoining head end of the body are covered by the same ink-tight layer, so that this layer can also serve outside the piezo-electric elements as a boundary of the ink passages.

Preferably, the ink-tight layer continues over the inlet where it is provided with one or more filter passages by means of which the ink-tight layer, i.e., at least that object, is given a further function and a filter can also be provided in one operation.

Advantageously, the ink-tight layer upstream of the ink propulsion means is provided with filter passages for passing and filtering ink to the ink ducts, so that the ink is filtered at the upstream end of the ink ducts.

Preferably, the ink ducts are continued in the upstream direction as far as the location of the filter passages and the ink-tight layer performs the function of outer boundary over the complete length of the ducts, from the inlet to the delivery nozzles.

BRIEF DESCRIPTION OF THE DRAWINGS

The invention will be explained with reference to one embodiment illustrated in the accompanying drawings wherein.

DETAILED DESCRIPTION OF THE INVENTION

Figure 2:
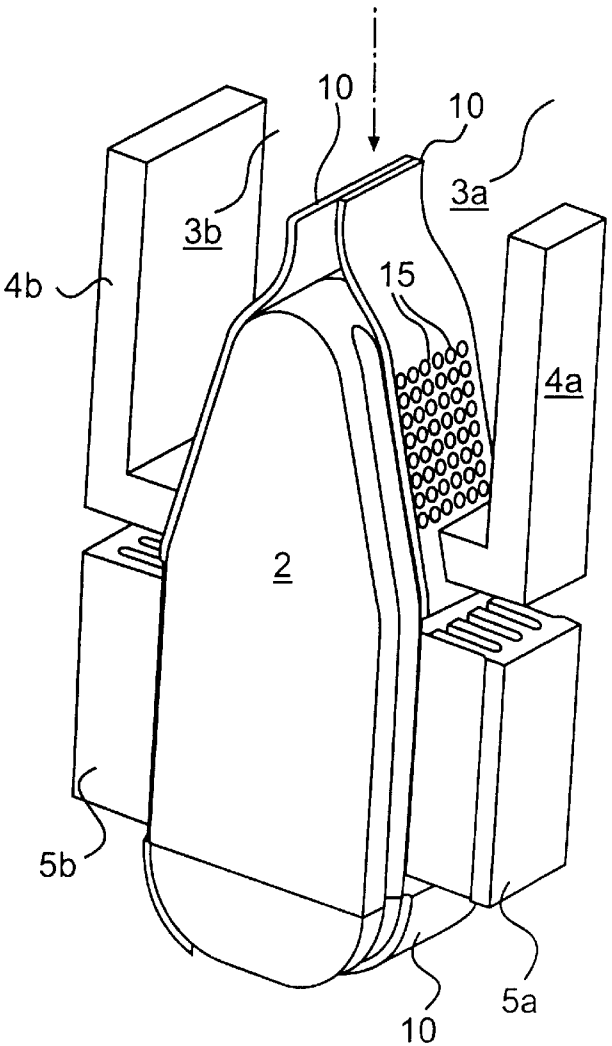
FIG. 2 is a different perspective view of the device shown in FIG. 1.
Figure 1:
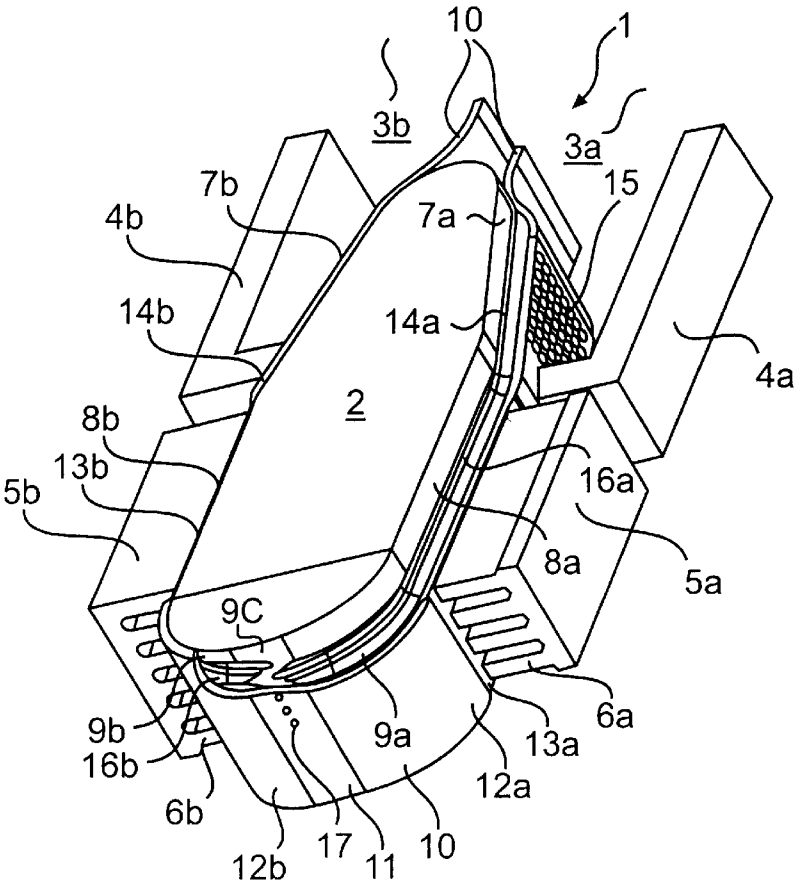
FIG. 1 is a bottom perspective view of one embodiment of the device according to the invention.

FIG. 1 shows a print head attachment 1 incorporating the elements according to the present invention. The print head attachment 1 comprises a base plate 2, made, for example, of ceramic material, the top part of which is provided with two oblique sides 7*a*, 7*b*, two parallel sides 8*a* and 8*b*, and curved surfaces 9*a*, 9*b*, which merge into a head surface 9*c*. Ink ducts 16*a*, 16*b* are milled in the sides or surfaces 7*a*, 8*a*, 9*a*, 9*c*, on the one hand, and 7*b*, 8*b*, 9*b* and 9*c*, on the other hand. These ducts are covered from the outside by a single foil 10, which is trained around the base plate 2 in the manner shown in the drawings, and fixed thereon. This foil may be a ceramic foil, a metal foil or a plastic film.

In the bottom part, the foil 10 is provided with a portion 11 formed with through holes or nozzles 17 which are in line with the ends of the ducts 16*a*, 16*b*. Curved foil portions 12*a*, 12*b*, are located on either side of the foil portion 11 and cover the ducts 16*a*, 16*b* in the transition zone 9*a*, 9*b* to the sides 8*a*, 8*b*. The foil 10 is then continued in portions 13*a*, 13*b* which form a flexible top boundary of the ducts 16*a*, 16*b*, which are subject to the action of the legs 6*a*, 6*b* of the piezo-electric elements or actuators 5*a*, 5*b*. The foil 10 then continues upwardly with portions 14*a*, 14*b*, in which filter passages 15 are provided, each in register with one of the ducts 16*a* or 16*b*, respectively. The filter passages 15 form the downstream boundary of ink distribution chambers 3*a*, 3*b*, which are also bounded by walls 4*a*, 4*b*, which here are shown purely diagrammatically, it being understood that they effectively surround the distribution chambers 3*a*, 3*b*. The drawing does not show that the ink distribution chambers are connected to an ink source.

The foil has a minimum thickness of 0.02 mm and is made of a flexible material, such as a metal foil or a plastic film. The foil can also have different thicknesses, e.g. 0.02 mm above the ducts and 0.1 mm level with the ink delivery nozzles.

The invention being thus described, it will be obvious that the same may be varied in many ways, such variations are not to be regarded as a departure from the spirit and scope of the invention, and all such modifications as would be obvious to one skilled in the art are intended to be included within the scope of the following claims.

What is claimed is:

1. A device for delivering ink to a sheet of paper or the like, which comprises a body member containing side surface portions which extend into a head surface portion, said head surface portion being inclined at an angle relative to the side surface portions and said body member between the end surface portion and the side surface portions being formed with a curved transition zone, said body member containing an ink inlet for letting in ink originating from an ink reservoir, ink delivery nozzles disposed at the head surface portion and ink passages in the form of ducts extending between said inlet and the ink delivery nozzles along one or more of the side surface portions of the body member, a first ink-tight layer which covers said ducts, said ducts terminating in ends at the ink delivery nozzles, and a second ink-tight layer which covers said ends of the ink passages in which the ink delivery nozzles are formed, and ink propulsion means operatively connected with said second ink-tight layer for selectively propelling ink through said ink passages to the ink delivery nozzles.

2. The device of claim 1, wherein the first ink-tight layer is a foil member.

3. The device according to claim 1, wherein the first ink-tight layer at the location of the ink propulsion means forms a unit with the second ink-tight layer at the location of the ink delivery nozzles.

4. The device according to claim 3, wherein the body is provided with two said side surface portions in which the ink passages are provided, said curved transition zone being provided to both sides, wherein the ink-tight layer extends as a unit over both side surface portions and over the head end portion.

5. The device according to claim 3, wherein the ink passages over the path from at least the ink propulsion means to the ink delivery nozzles are formed as through ducts in said side surface portions, the transition zone and the adjoining head end portion of the body member and are covered by the same ink-tight layer.

6. The device according to claim 3, wherein the ink-tight layer continues to extend over the inlet where it is provided with one or more filter passages.

7. The device according to claim 6, wherein the ink-tight layer upstream of the ink propulsion means is provided with filter passages for passing and filtering ink to the ink ducts.

8. The device according to claim 7, wherein the ink ducts are continued in the upstream direction to the location of the filter passages.

9. The device of claim 1, wherein the ink propulsion means are piezo-electric elements.

10. A printer provided with the device of claim 1.

* * * * *